US009579588B2

(12) United States Patent
Sokolov

(10) Patent No.: US 9,579,588 B2
(45) Date of Patent: Feb. 28, 2017

(54) CONSTRUCTION ELEMENTS AND CONSTRUCTION TOY

(71) Applicant: Dmitriy Andreyevich Sokolov, Moscow (RU)

(72) Inventor: Dmitriy Andreyevich Sokolov, Moscow (RU)

( * ) Notice: Subject to any disclaimer, the term of this patent is extended or adjusted under 35 U.S.C. 154(b) by 0 days.

(21) Appl. No.: 14/346,079

(22) PCT Filed: May 22, 2013

(86) PCT No.: PCT/RU2013/000420
§ 371 (c)(1),
(2) Date: Mar. 20, 2014

(87) PCT Pub. No.: WO2014/062082
PCT Pub. Date: Apr. 24, 2014

(65) Prior Publication Data

US 2015/0209684 A1 Jul. 30, 2015

(30) Foreign Application Priority Data

Nov. 22, 2012 (RU) ..... 2012149600

(51) Int. Cl.
*A63H 33/04* (2006.01)
*A63H 33/08* (2006.01)
*A63F 9/12* (2006.01)

(52) U.S. Cl.
CPC ..... *A63H 33/04* (2013.01); *A63F 9/1204* (2013.01); *A63F 9/1208* (2013.01); *A63H 33/08* (2013.01)

(58) Field of Classification Search
CPC ..... E04B 2/14; E04B 2/42; E04B 2002/0295; E04B 2002/0297; E04C 1/395; E04C 1/40; A63H 33/04; A63H 33/046; A63H 33/062; A63H 33/084; A63F 9/12
See application file for complete search history.

(56) References Cited

U.S. PATENT DOCUMENTS 1,216,840 A * 9/1917 Ramsey et al. ..... 446/122
1,294,446 A * 2/1919 Greenstreet ..... 446/122
(Continued)

FOREIGN PATENT DOCUMENTS

CN 2907810 Y 6/2007
KR 20120002789 A 1/2012
(Continued)

*Primary Examiner* — Aarti B Berdichevsky
*Assistant Examiner* — Urszula M Cegielnik
(74) *Attorney, Agent, or Firm* — Mark David Torche; Patwrite LLC

(57) ABSTRACT

This invention relates to construction components, and particularly to those used in toy construction sets and puzzles. A construction component has at least two interlocking joints, each of them is made in the form of a volumetric body with faces, at least part of which lie in the planes of the cube faces where cube face length is equal to <<a>>, where protrusions are made on at least one of the aforementioned faces, having a height ≥<<a/2>> and containing four sections, arranged individually in the planes of the cube faces and adjacent to the face on which protrusions are made, wherein each face of the interlocking joint, lying on the plane of the faces of the cube, lies either in the plane of one of the faces of another interlocking joint or in the plane parallel to the plane of one of the faces of the other interlocking joint.

4 Claims, 28 Drawing Sheets

(56) References Cited

U.S. PATENT DOCUMENTS

| | | | | | |
|---|---|---|---|---|---|
| 2,787,458 | A | * | 4/1957 | Reintjes | 165/9.4 |
| 3,672,110 | A | * | 6/1972 | Nordstrom | 52/608 |
| 3,867,784 | A | | 2/1975 | Lange | |
| 4,310,994 | A | * | 1/1982 | Gephardt | 52/608 |
| 4,370,075 | A | * | 1/1983 | Scales | 405/20 |
| 4,594,023 | A | * | 6/1986 | O'Neill | 405/29 |
| 4,643,427 | A | * | 2/1987 | Wozniak | 273/160 |
| 5,108,219 | A | * | 4/1992 | Hair | 404/41 |
| 5,122,015 | A | * | 6/1992 | Shen | E02D 29/025 52/592.6 |
| 5,199,919 | A | | 4/1993 | Glickman | |
| 5,560,173 | A | * | 10/1996 | Scheiwiller | B44C 3/123 404/41 |
| 5,575,120 | A | | 11/1996 | Handley | |
| 5,827,105 | A | * | 10/1998 | Felgenhauer et al. | 446/120 |
| 7,429,144 | B1 | * | 9/2008 | Lai | 404/40 |
| 8,157,608 | B1 | * | 4/2012 | Stapleton | 446/124 |
| 9,238,179 | B2 | | 1/2016 | Carpenter | |
| 2003/0082986 | A1 | | 5/2003 | Wiens et al. | |
| 2003/0093967 | A1 | * | 5/2003 | Dolan et al. | 52/604 |
| 2009/0117815 | A1 | | 5/2009 | Hiraide | |
| 2011/0045733 | A1 | | 2/2011 | Saigo et al. | |
| 2013/0247503 | A1 | * | 9/2013 | Yong et al. | 52/604 |

FOREIGN PATENT DOCUMENTS

| | | | |
|---|---|---|---|
| RU | 4236 | U1 | 6/1997 |
| RU | 2150985 | C1 | 6/2000 |
| RU | 2199364 | C2 | 2/2003 |
| RU | 2441686 | C2 | 2/2012 |
| RU | 2468848 | C1 | 12/2012 |
| SU | 1507411 | A1 | 9/1989 |

* cited by examiner

CONSTRUCTION ELEMENTS AND CONSTRUCTION TOY

CROSS REFERENCE TO RELATED APPLICATIONS

The present application is a US National stage application from PCT application No. PCT/RU2013/000420 filed on filed on May 20, 2013, which originates from Russian patent application No. RU2012149600 filed on Nov. 22, 2012.

TECHNICAL FIELD

This invention relates to construction components, and particularly to construction components (elements) that can be used both in toy construction sets and puzzles.

BACKGROUND

One known analog from prior art is the construction component containing a base, which is created, as a rule, in the form of a parallelepiped with one or more interlocking joints to connect the analogous (similar) components together (patent RU 2150985 of 20 Jun. 2000).

A disadvantage of the known construction component is poor functionality because its design permits only one possible type of connection between identical construction components.

SUMMARY OF THE INVENTION

The object of the claimed invention is to create a construction component which provides many options for interlocking similar components.

The technical result comprises increasing the functional possibilities of the construction component by increasing the connection options of the proposed construction component with other components of the same type.

The technical result of the first construction component embodiment is achieved due to the construction component having at least two interlocking joints, each of which is made in the form of a volumetric body with faces. At least part of these faces lie in the planes of the cube faces with cube rib length equal to <<a>>. At least one of the above faces is made with protrusions having a height equal to no more than <<a/2>> and containing four sections. The sections are positioned individually on the planes of the faces adjacent to the cube face where the protrusions are made. The distance between the centers of adjacent cubes lying on the axis perpendicular to the cube faces is equal to <<2a>> with the possibility for contact between protrusion segments and protrusion segments of linkable construction components. Each face of the interlocking joint lying in the plane of the cube face is either in a plane of the cube faces of another connector or parallel to the plane of the cube faces of the other connector.

The technical result of the second embodiment of the construction component is achieved by the construction component containing an interlocking joint which is made in the form of a volumetric body with faces which at least partly lies in the planes of the cube faces and the cube rib length is equal to <<a>>. At least one of the above faces is made with protrusions over the faces where the height of these protrusions relative to the faces does not exceed <<a/2>> and every face contains four sections. Sections are arranged individually in the plane of the cube face adjacent to the face on which these protrusions are made.

The technical result of the construction is achieved by having construction components where part of them are created with one interlocking joint and the other part is made with two or more interlocking joints, The interlocking joint is made in the form of volumetric body with faces and at least part of which are in the plane of the cube faces with the cube rib length equal to "a". At least one of the aforementioned faces has protrusions on the surface with a height relative to the faces not exceeding "a/2" and has four sections. Sections are arranged individually of the cube faces on the plane, adjacent to foe face on which the protrusions are made. The distance between the centers of neighboring cubes lying on the axis perpendicular to cube faces is equal to <<2a>>.

There is a possibility of contact between aforementioned sections and the interlocking construction components, where each side of the interlocking joint lying in the plane of the cube face is either in one of the planes of the cube faces of another interlocking joint or in the plane that is parallel to the plane of one of the cube faces of the other interlocking joint.

BRIEF DESCRIPTION OF DRAWINGS

The invention can be illustrated with reference to the accompanying drawings, in which.

DETAILED DESCRIPTION OF THE PREFERRED EMBODIMENTS

Figure 1:
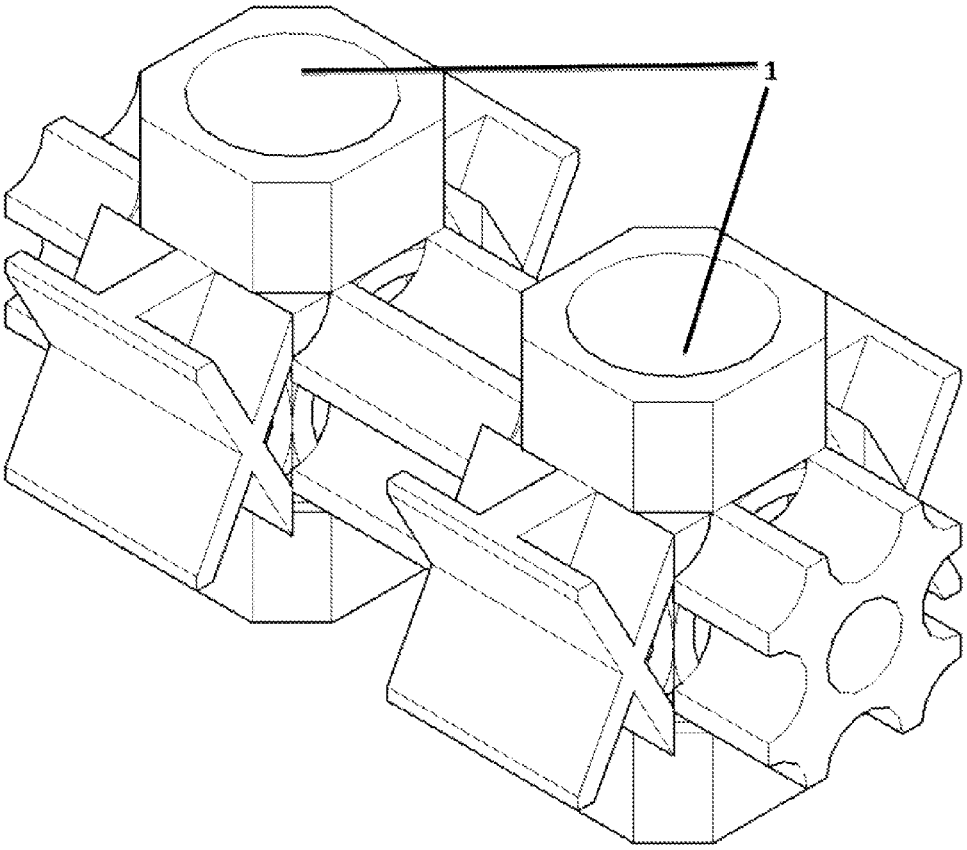
FIG. 1 is a view of the construction component with two interlocking joints.
Figure 2:
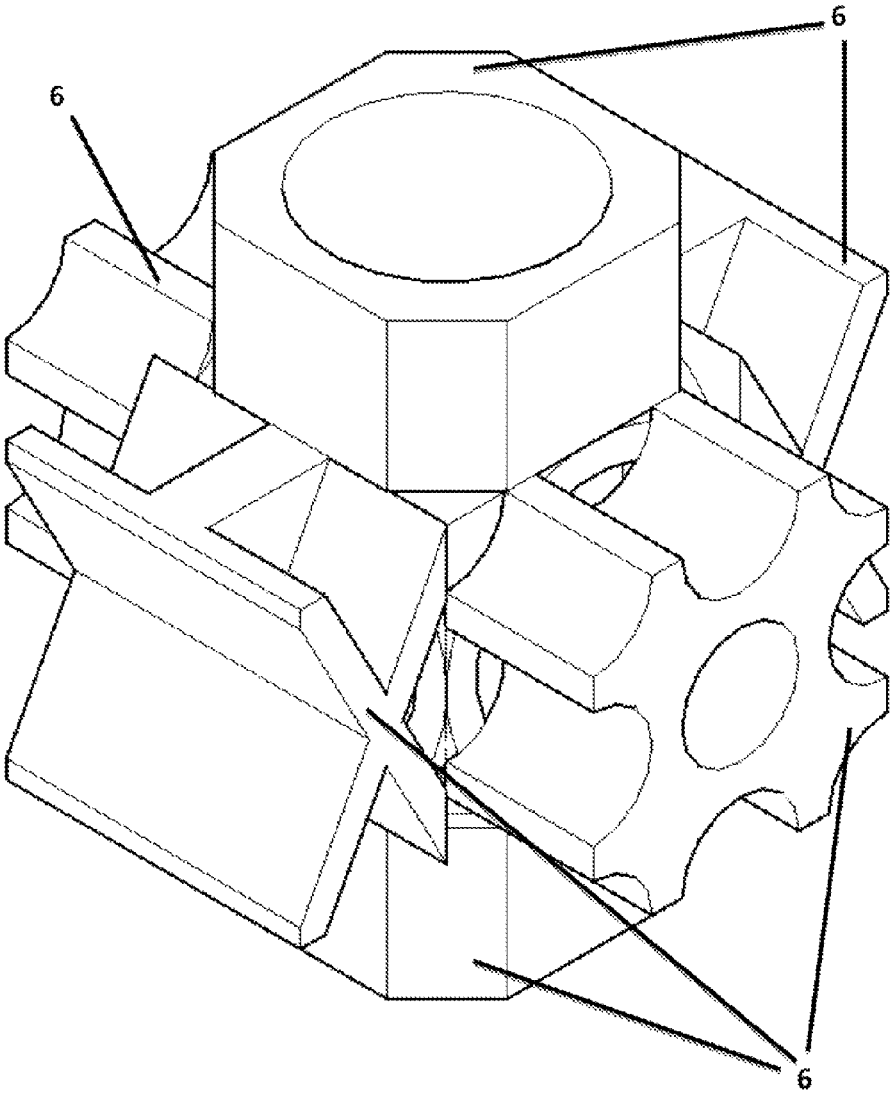
FIG. 2 shows three different embodiments of the interlocking joint with six protrusions.
Figure 17:
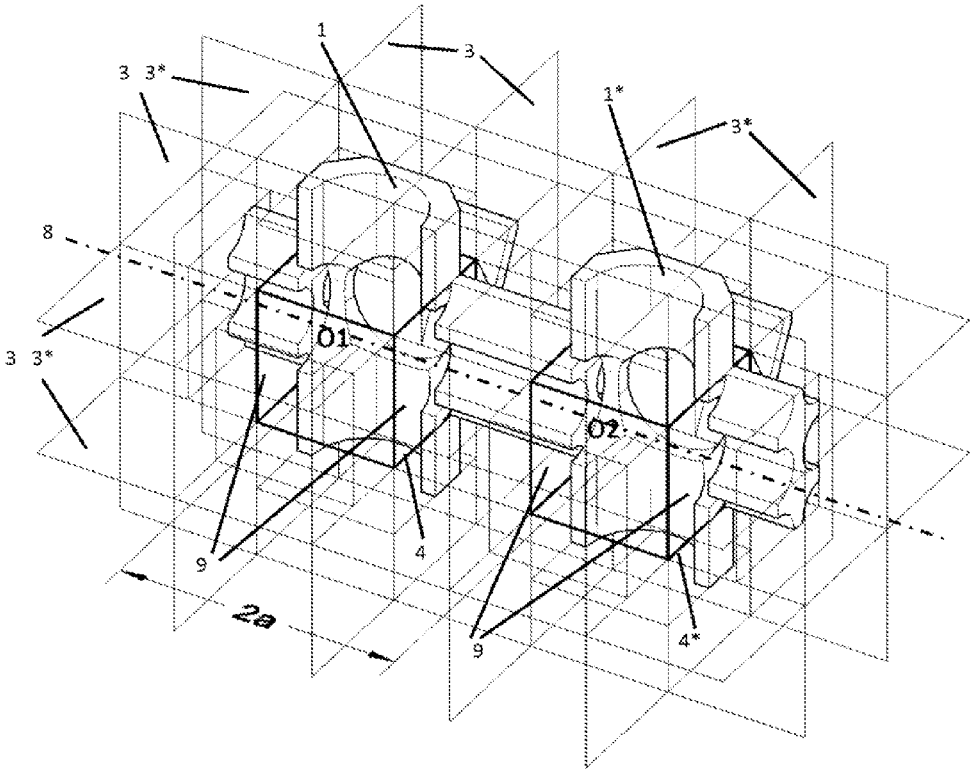
FIG. 17 is a cross-section of a construction component.
Figure 18:
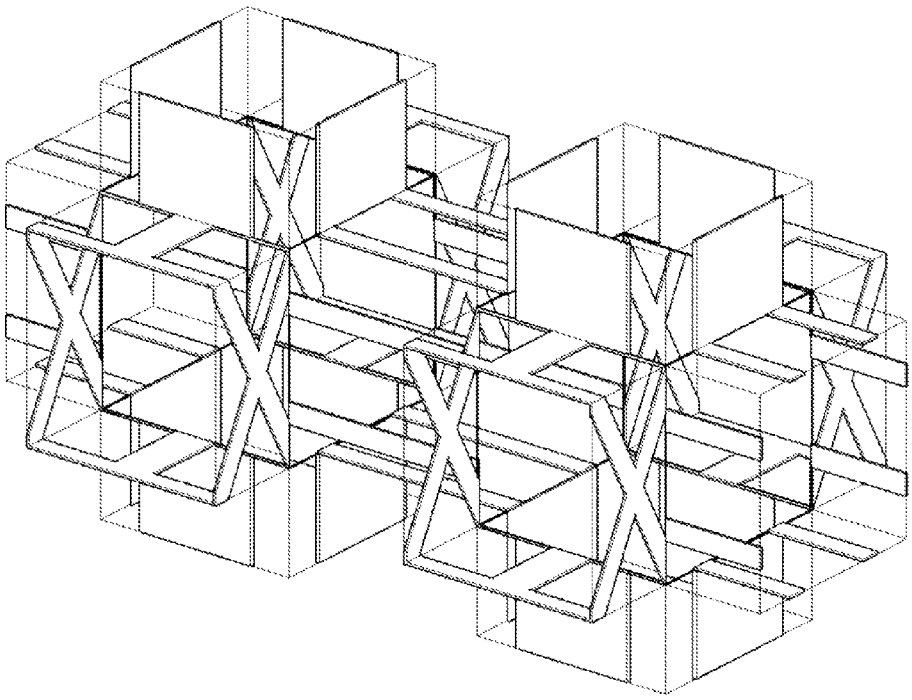
FIG. 18 depicts protrusion areas of interlocking joints located in the planes of the cube faces adjacent to the faces, on which the aforementioned protrusions are made for a component with two interlocking joints as shown in the FIG. 1.
Figure 19:
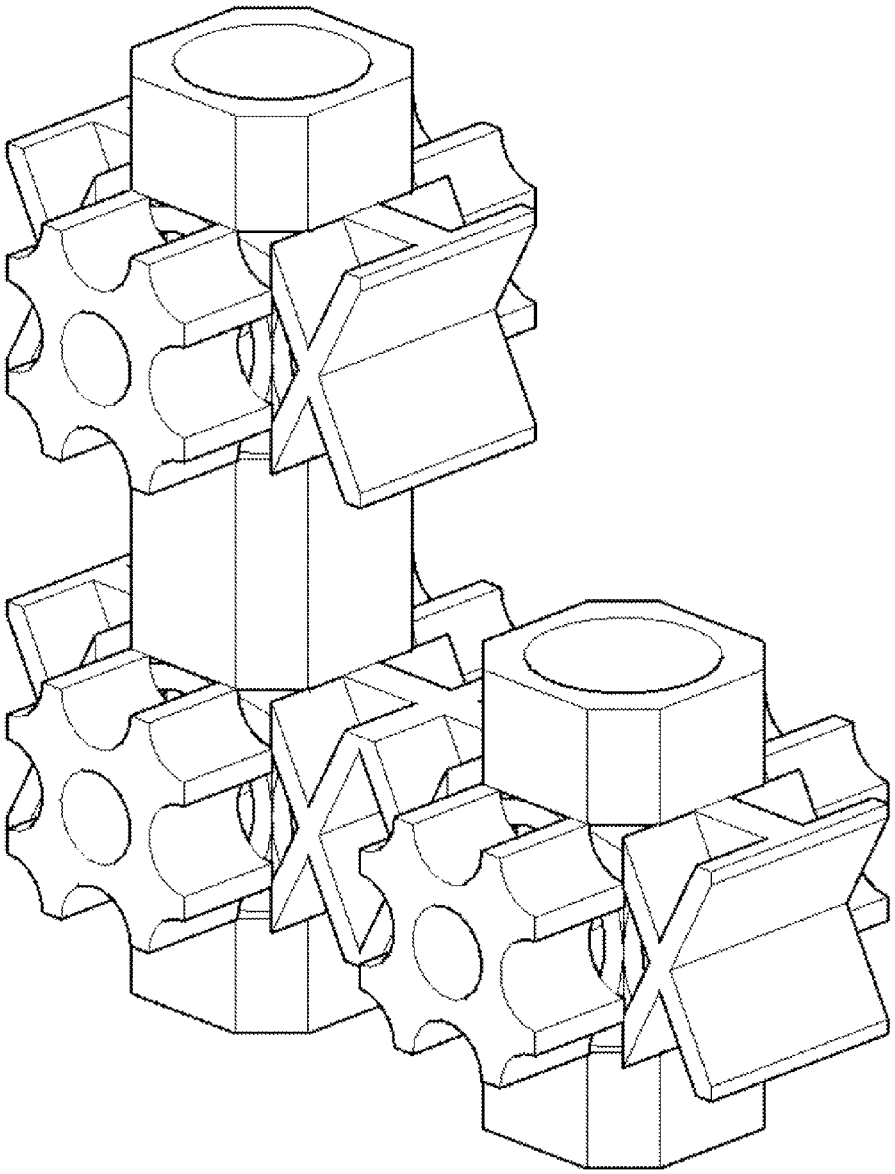
FIG. 19 shows a construction component with three interlocking joints.
Figure 20:
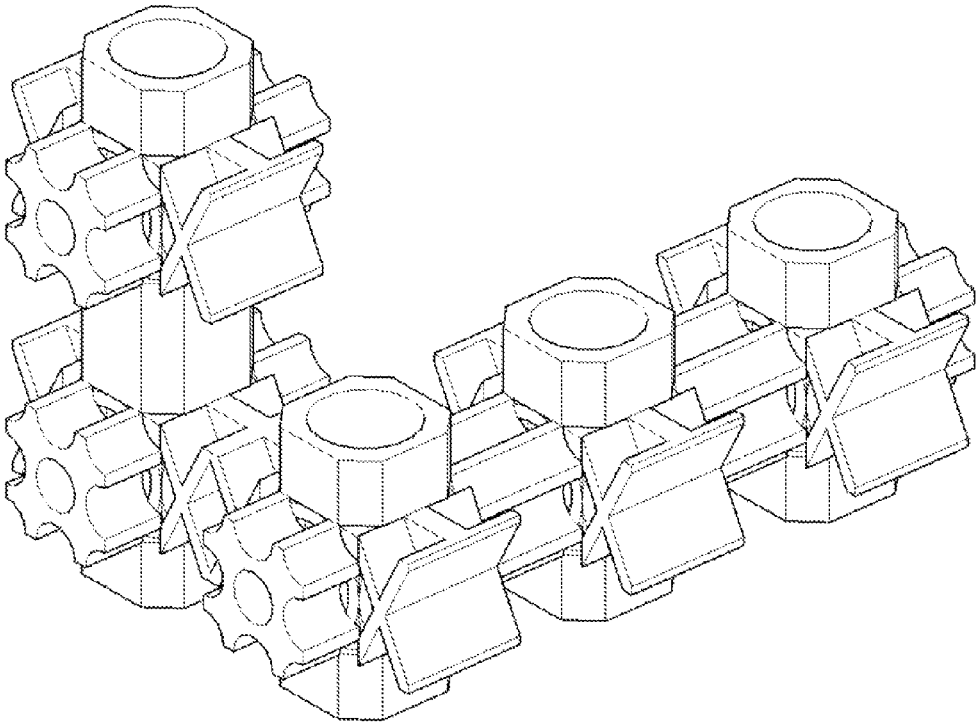
FIG. 20 shows a construction component with five interlocking joints.
Figure 21:
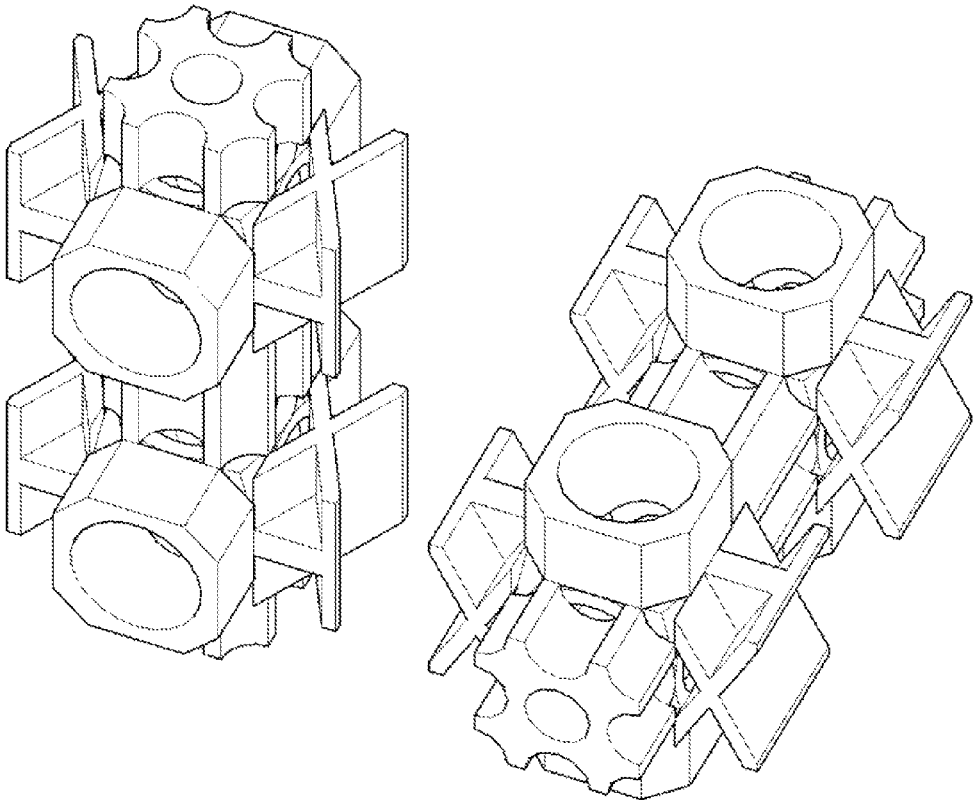
FIG. 21 shows two construction components with two interlocking joints.

The construction component according to the first embodiment option (see FIG. 1) contains at least two interlocking joints 1 (see FIG. 1), each of them is made in the form of a volumetric body with outer faces 2 (see FIGS. 2-8) of a cube 4. At least part of the outer faces 2 lie in the planes 3 of the cube 4 where the cube edge length 5 equal to <<a>>. At least one of the outer faces 2 has protrusions 6 (see FIGS. 2, 10), having a height that does not exceed <<a/2>>. The protrusions 6 contain four sections 7 (FIGS. 9-16). Sections 7 are arranged individually in (and peripherally defined by) the planes 3 of the outer faces 2 of cube 4 and adjacent to the protrusion section face on which protrusions 6 in FIG. 10). The distance between the centers <<$O_1$>>, <<$0_2$>> (FIG. 17) of neighboring cubes 4 lying on the axis 8 that is perpendicular to faces 9 of cubes 4 and 4* is equal to <<2a>> (FIG. 17). There is the possibility of contact between protrusion sections 7 and an adjacent interlocking joint 1* of a neighboring construction component (see FIG. 18, which shows protrusion sections 7 that come into contact with similar sections 7 of a neighboring interlocking component). Each cube outer face 2 of the interlocking joint 1, lying on the plane 3 of the outer faces 2 of the cube 4, lies either in the plane 3* of one of the outer faces 2 of the cube 4* of another (adjacent) interlocking joint 1* or in the plane 3 parallel to the plane 3* of one of the outer faces 2 of the cube 4* of the other interlocking joint 1* (see FIG. 17).

Figure 7:
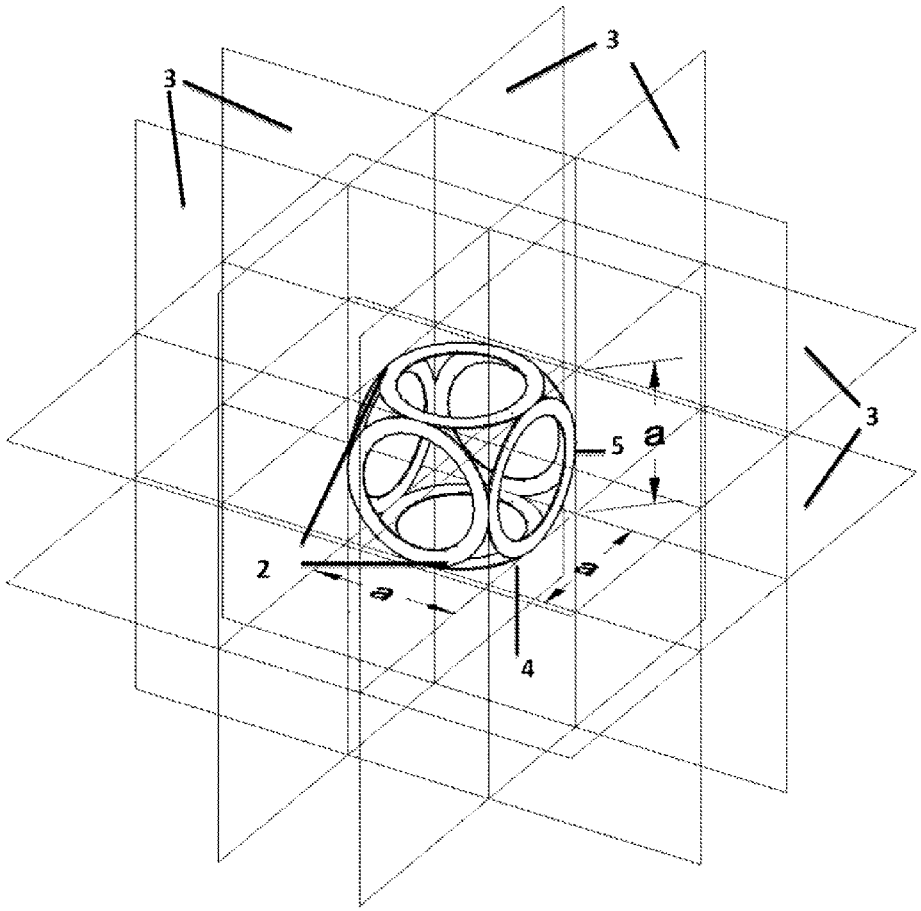

A construction component according to the second embodiment (see FIG. 2) contains an interlocking joint in the form of volumetric body with the cube's outer faces 2 (see FIG. 4) in the planes 3 of the cube 4 with cube edge length 5 equal to <<a>> (FIG. 7 shows these types of faces). Protrusions 6 are made on at least one of the faces 2 (see FIGS. 2, 10). Their height does not exceed <<a/2>> and the protrusions 6 contain four sections 7. Sections 7 are each arranged on the planes 3 of the cube's outer faces 2 adjacent to a face on the protrusions 6.

The construction is characterized by a set of components (see FIGS. 1, 2, 19, 20) part of which is made with one interlocking joint 1 whereas the other part is made with two or more interlocking joints. The interlocking joint 1 is made in the form of a volumetric body with outer faces 2 that at least partly lie in the planes 3 of the cubes 4, which have an edge length equal to <<a>>. At least one of the cubes 4 has protrusions 6 having a height that does not exceed <<a/2>> and contain four sections 7. The sections 7 are each arranged on the planes 3 of the cubes 4 (the cube's outer faces 2) adjacent to a face on the protrusions 6.

The distance between the centers of neighboring cubes, lying on the axis perpendicular to faces of a cube is made equal to <<2a>> with a possibility of contact of interlocking construction components with aforementioned sections, with each face of the interlocking joint, lying on the plane of the cube face, is either in a plane of one of the cube faces of another interlocking joint or in a plane that is parallel to one of the planes of the cube faces of the other interlocking joint.

Figure 3:
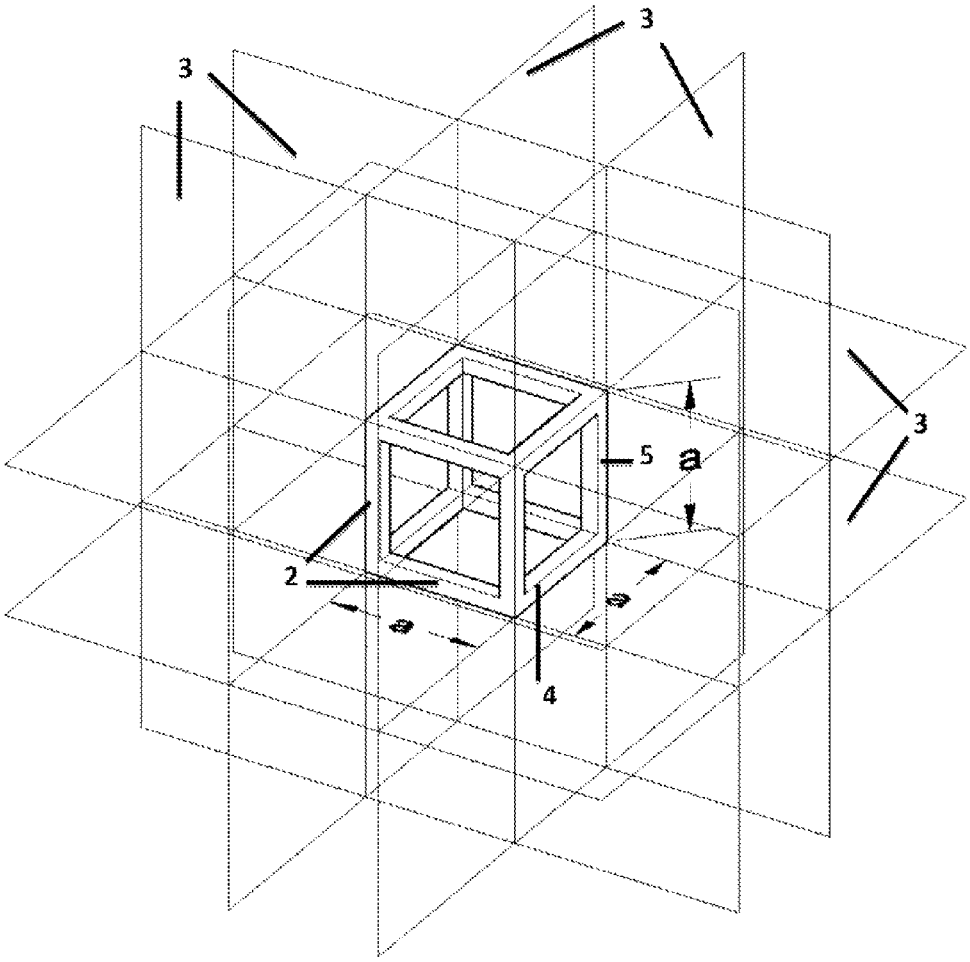
FIGS. 3-5 illustrate the interlocking joints without any protrusions.
Figure 4:
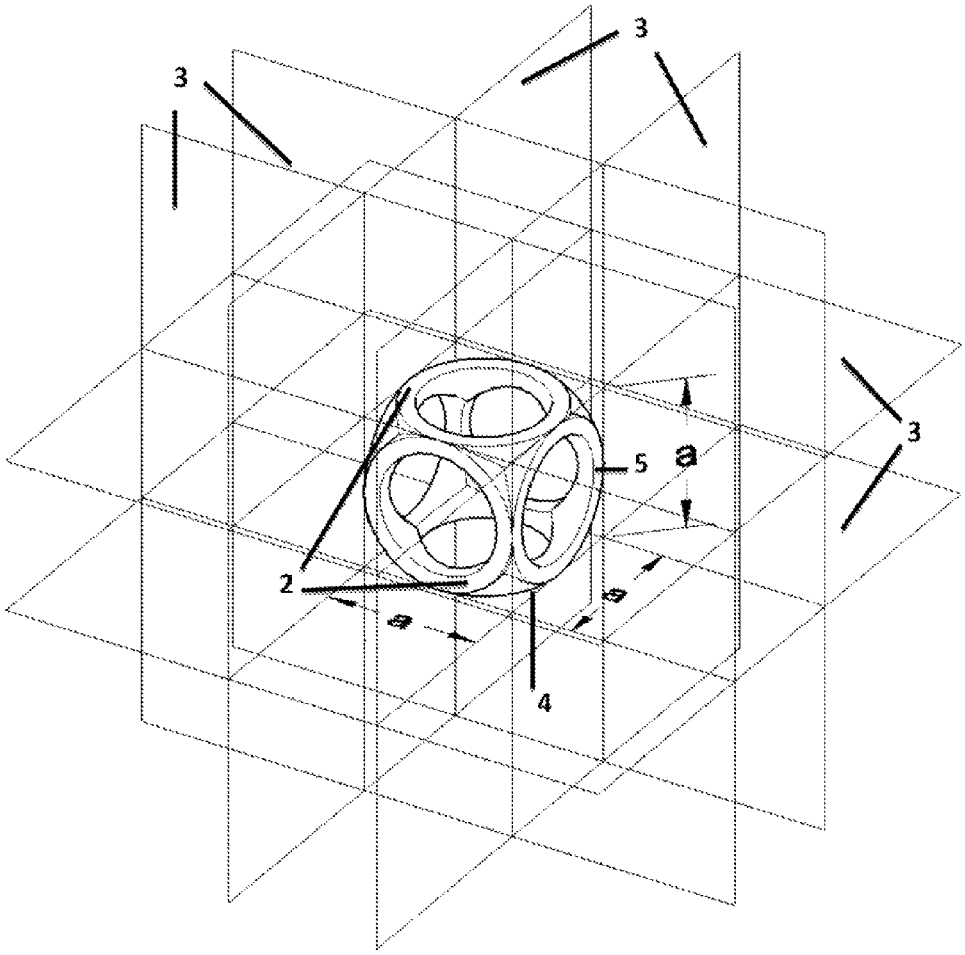
Figure 5:
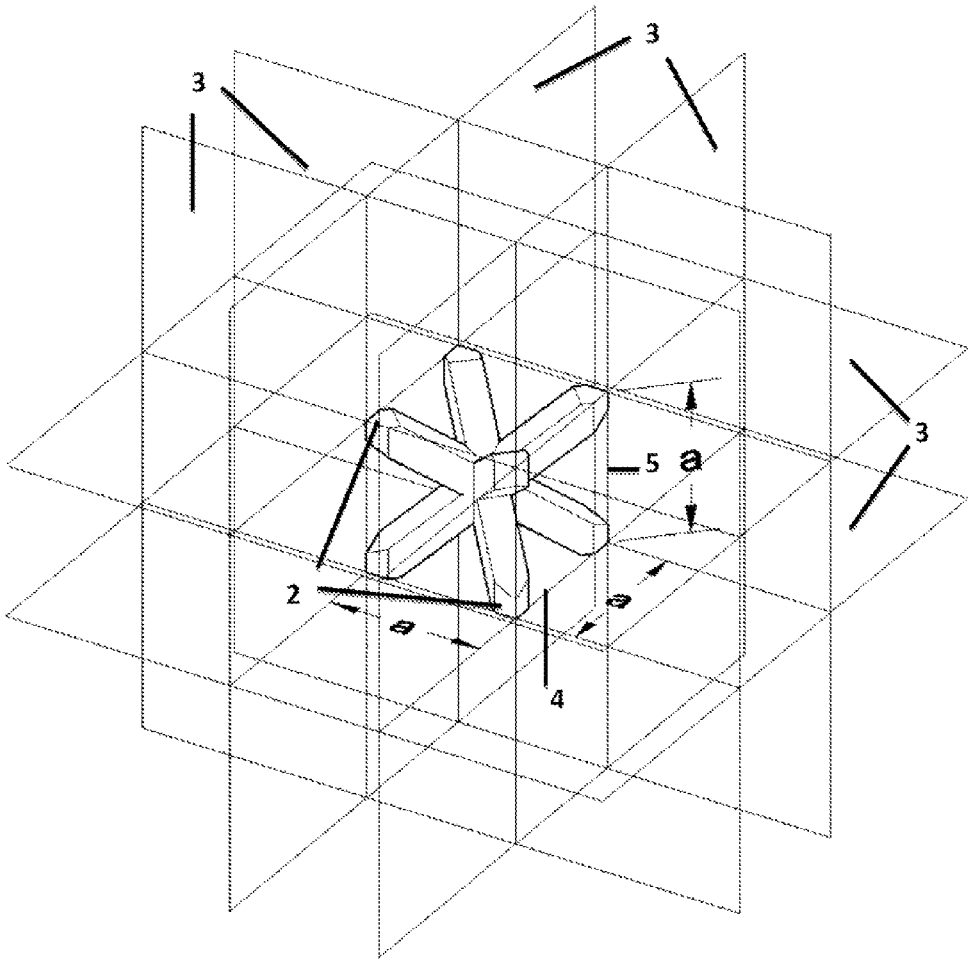
Figure 6:
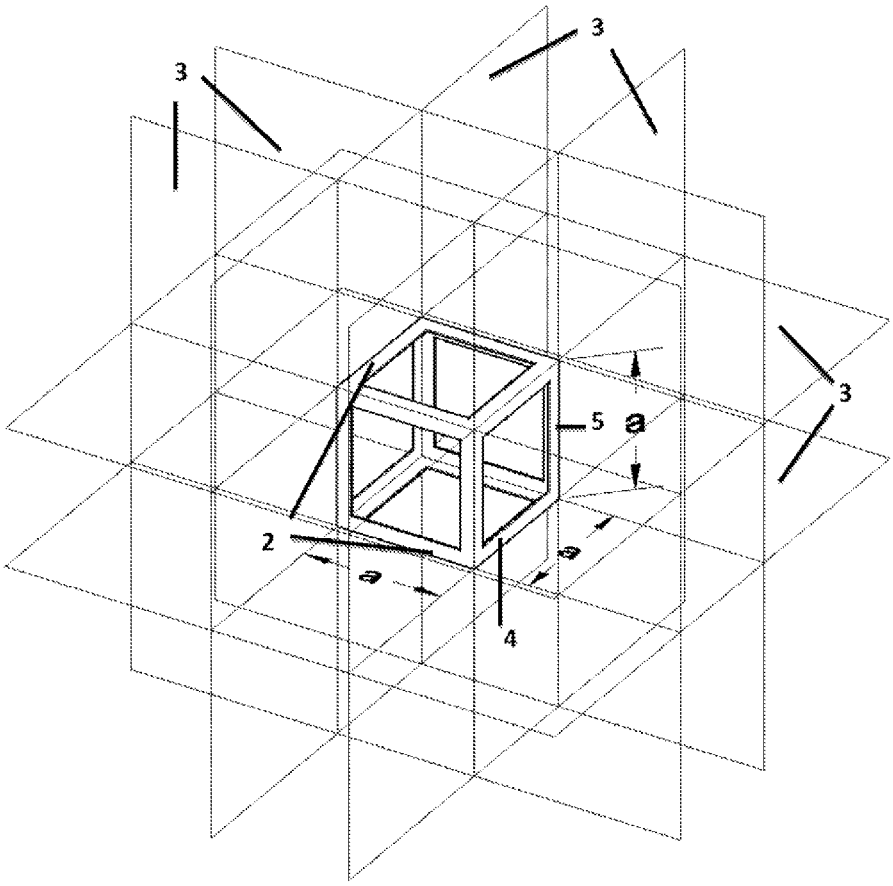
FIGS. 6-8 show the faces of interlocking joints located in the planes of the cube faces.
Figure 8:
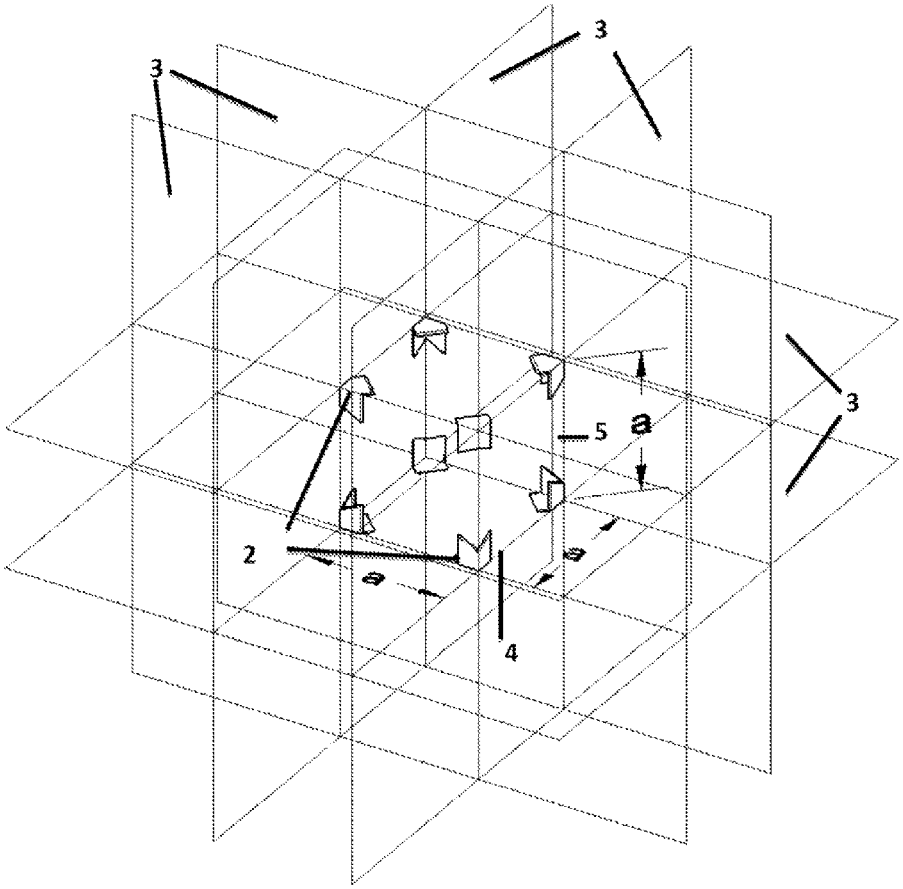
Figure 9:
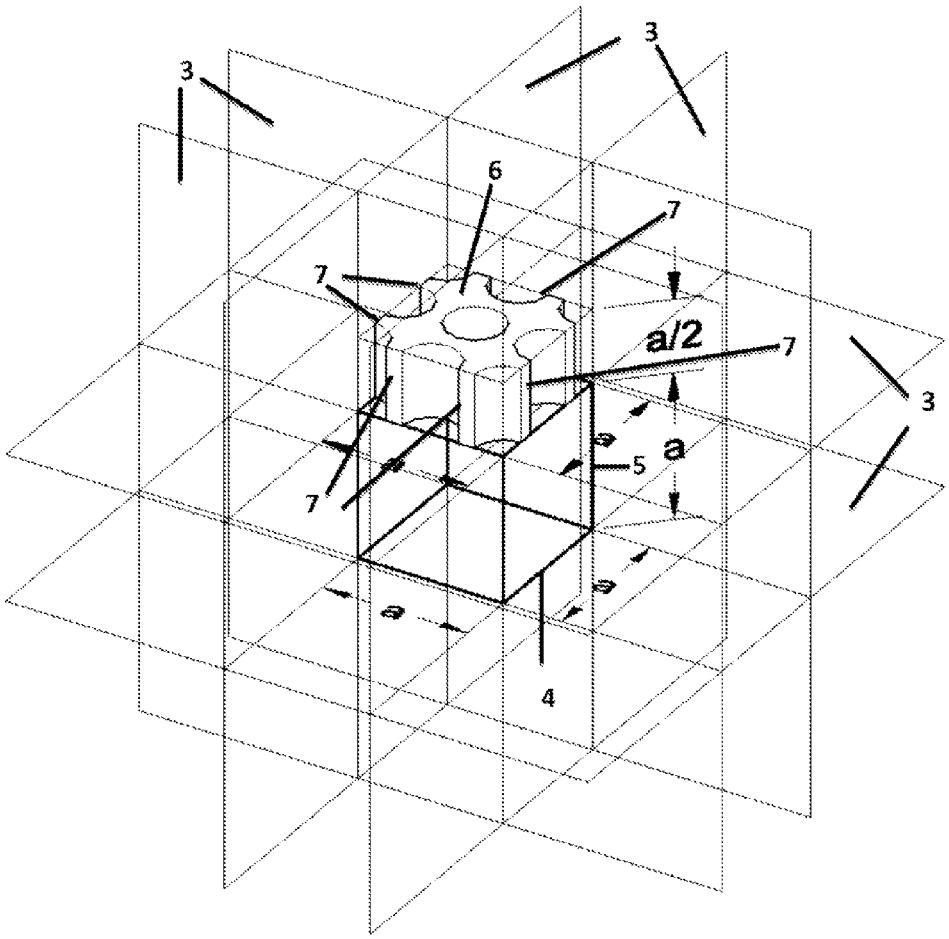
FIGS. 9-12 shows the protrusions of the interlocking joint in different implementations.
Figure 10:
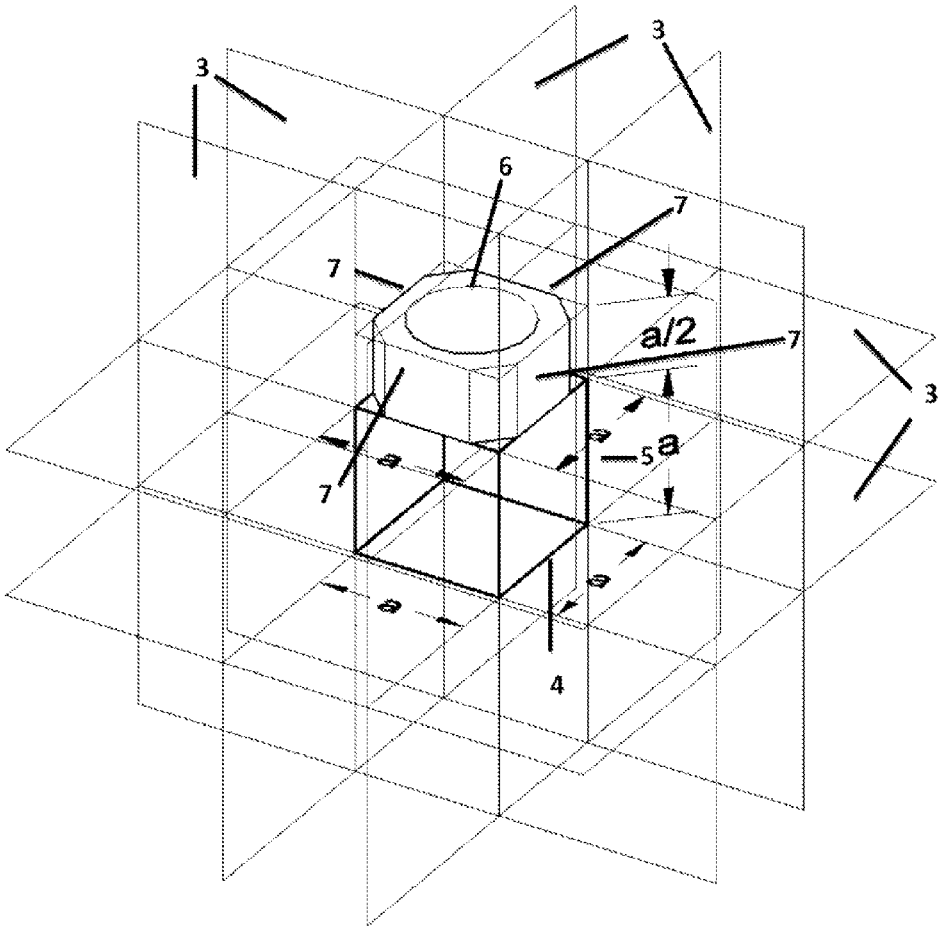
Figure 11:
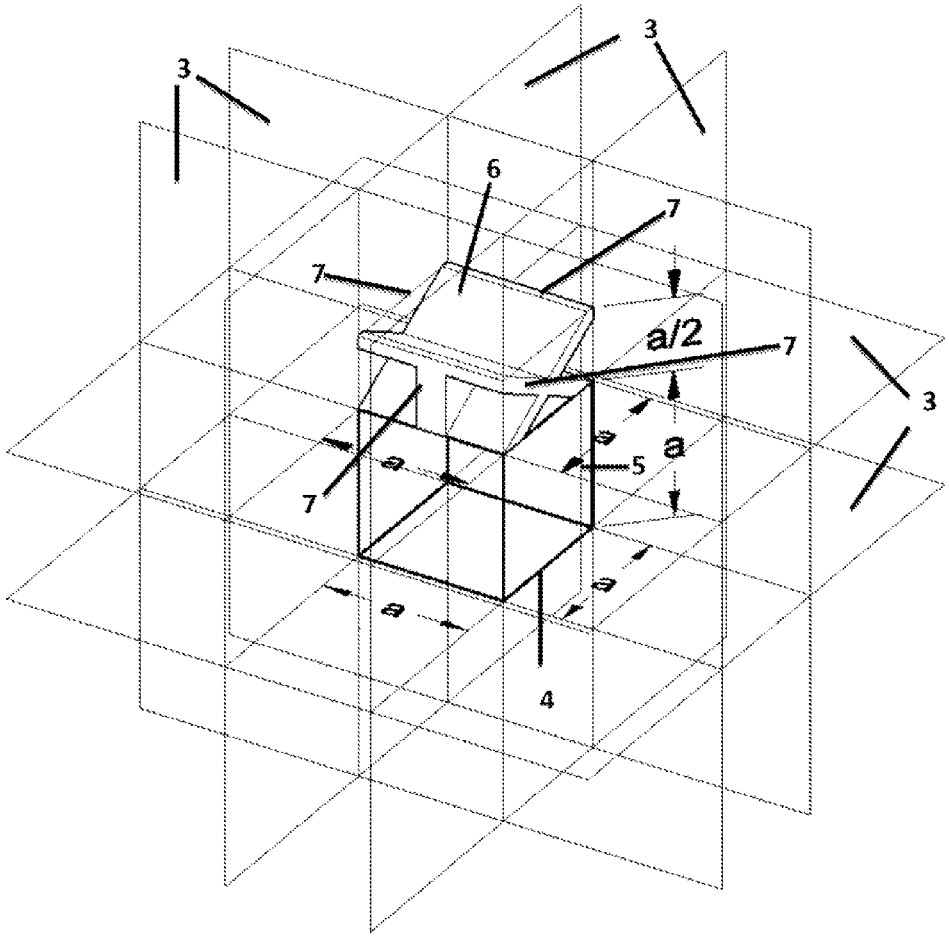
Figure 12:
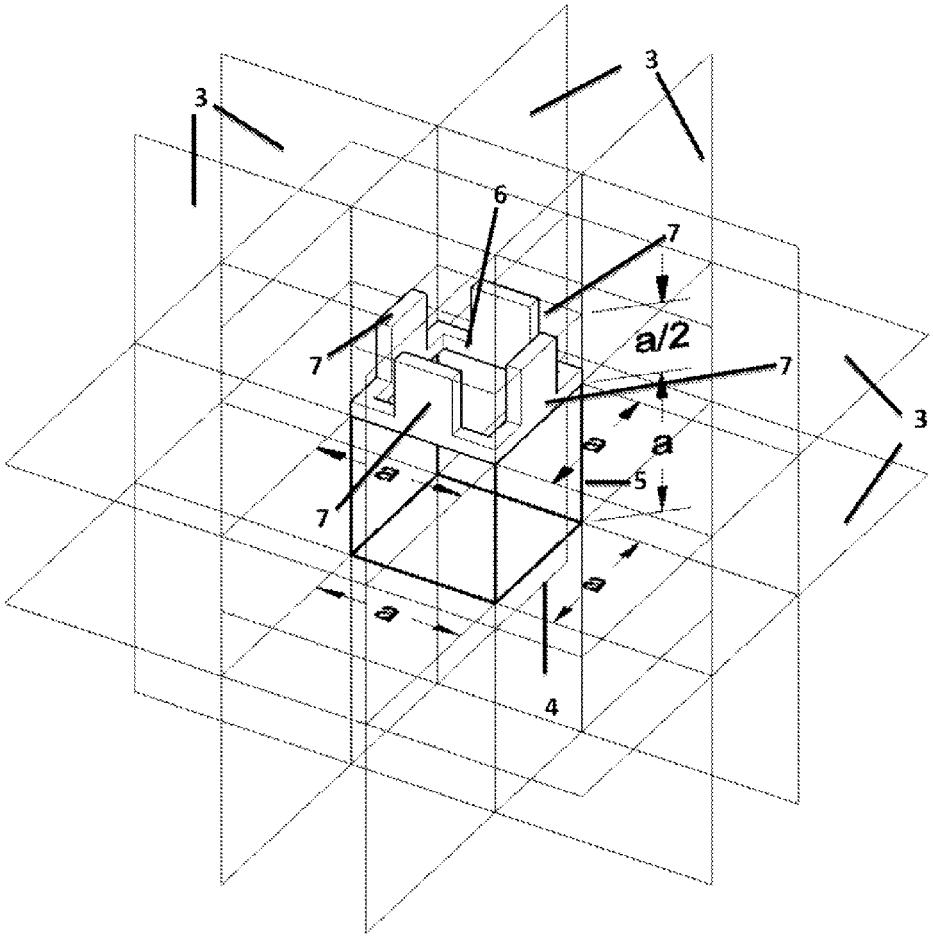
Figure 13:
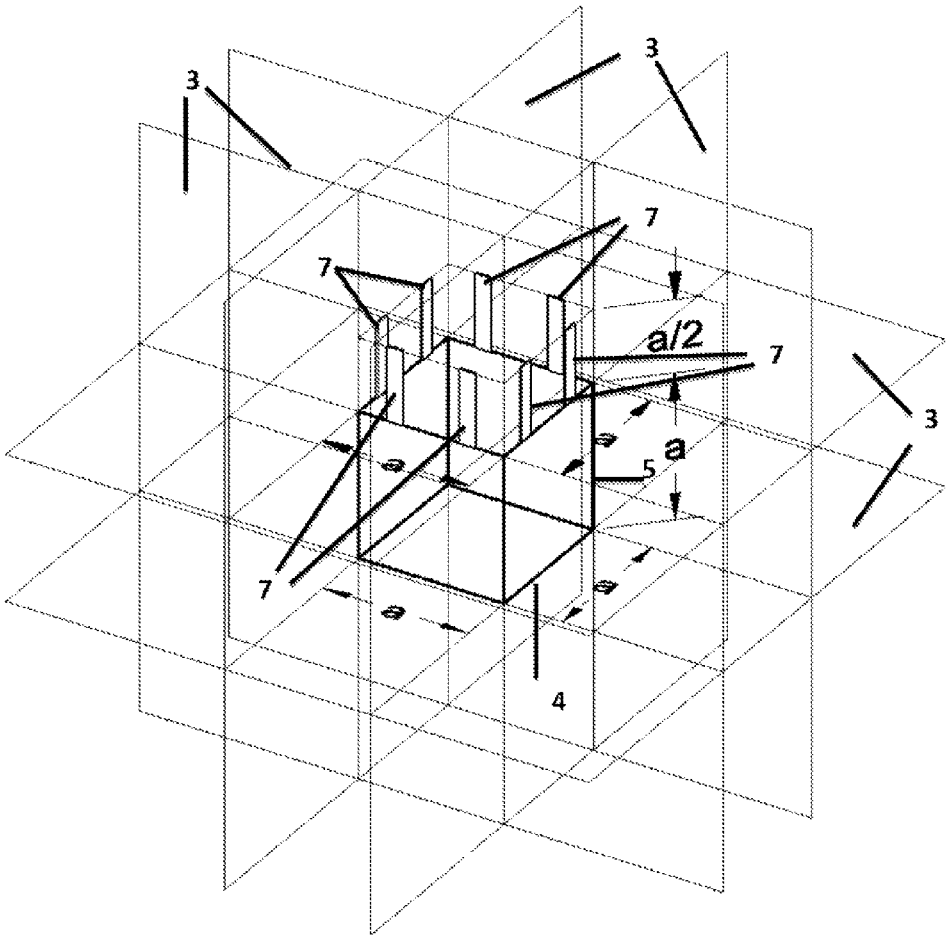
FIGS. 13-16 provide the view of the sections of the protrusions of the interlocking joint located in the planes of the cube faces adjacent to the face on which the protrusion is made, and these protrusions correspond to the protrusions shown in FIGS. 9-11.
Figure 14:
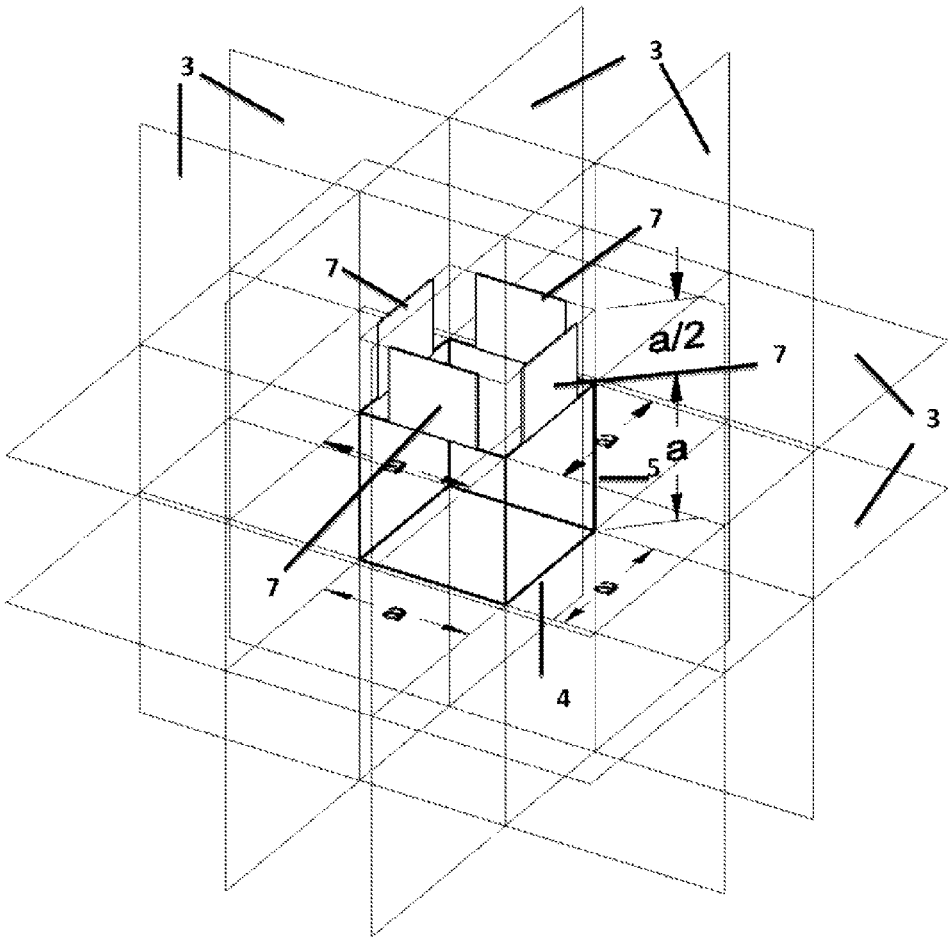
Figure 15:
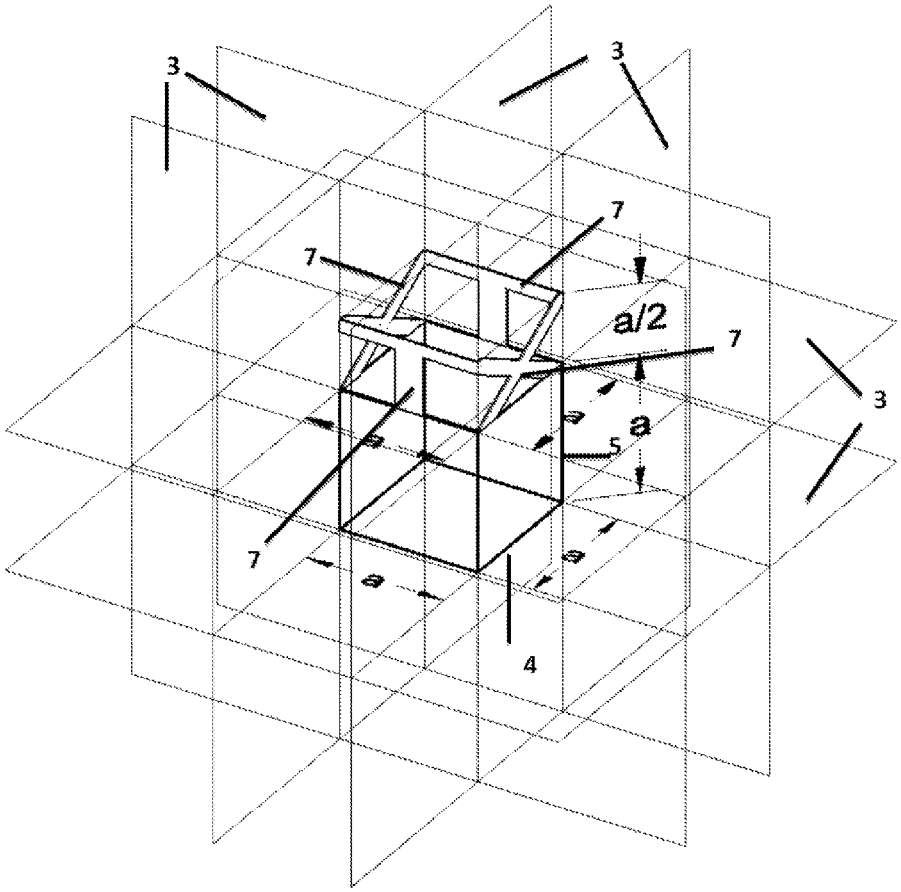
Figure 16:
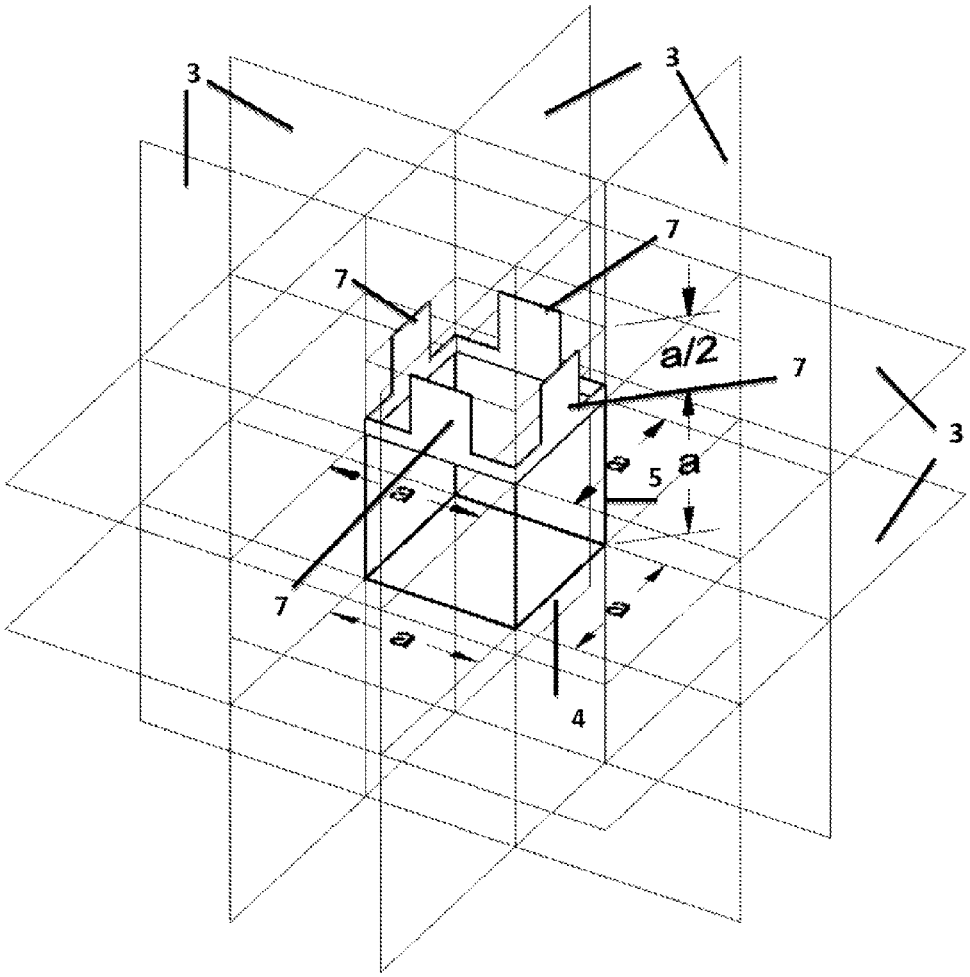

The interlocking joint (FIG. 2) can have different versions of the base implementation. Some options are presented in FIGS. 3, 4 and 6. It is necessary that the faces of the base, lying in planes of the cube faces, could ensure a strong connection with the protrusions (these faces for the bases from FIGS. 3, 4, 6 are shown in FIGS. 6, 7, 8). Also, the base shape should ensure ease of manufacturing of the interlocking joint and material savings. Three presented options of bases do not exhaust all possible options of base embodiments limited by the claims.

FIGS. 9-12 show five options of implementing the protrusions. The interlocking joint can simultaneously have protrusions of one implementation or another. It is necessary that during connection of components the protrusion sections, located on the plane of the cube face, adjacent to the face, on which the protrusion is made, make contact with analogous protrusion sections of the component being connected, ensuring stable connection of connected components due to the friction that arises between these sections in the area of their contact. FIGS. 13-16 show only the above-described areas of the protrusions shown in FIGS. 9-12. Moreover the shape of the protrusions should provide ease of manufacturing and material savings.

Five presented options of protrusions do not exhaust all possibilities of protrusion implantations limited by the claims.

Figure 22:
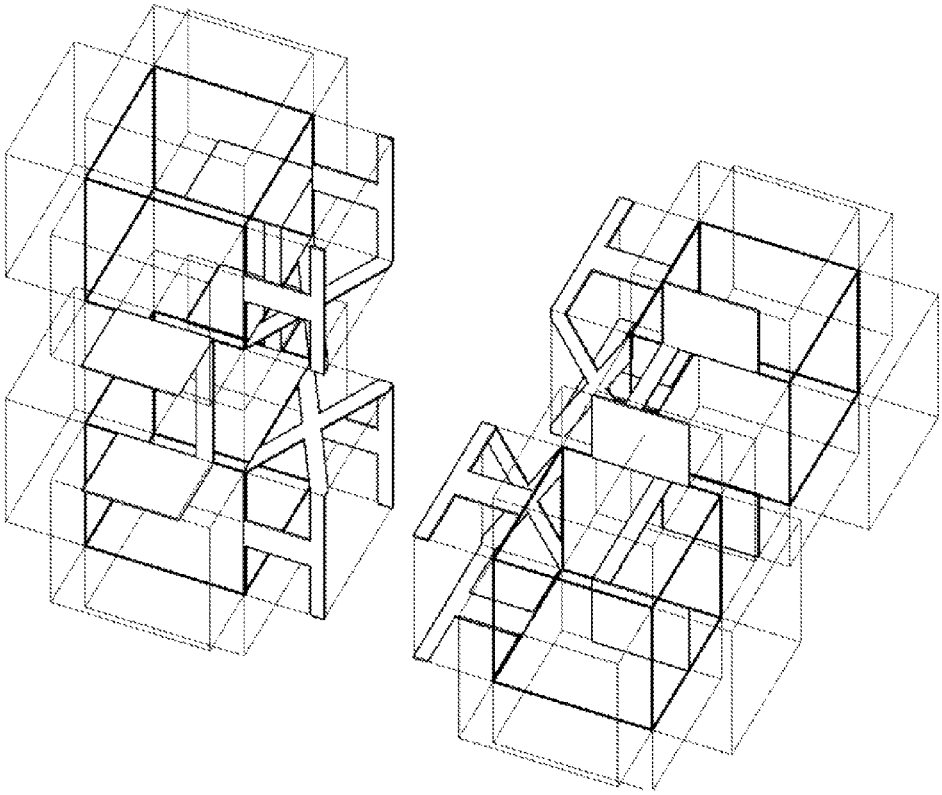
FIG. 22 depicts the protrusion sections of two construction components coming into contact with two interlocking joints when interlocking the components.
Figure 23:
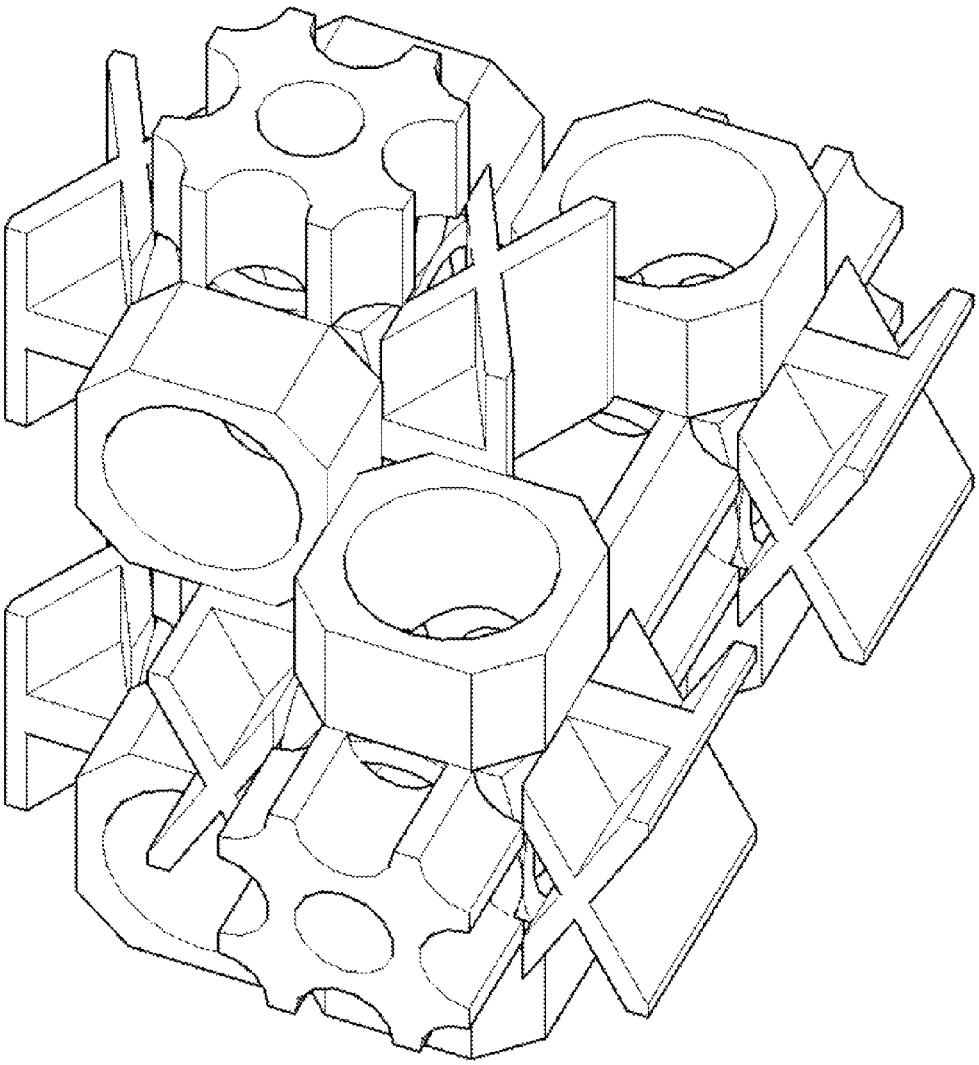
FIG. 23 shows two connected construction components with two interlocking joints.
Figure 24:
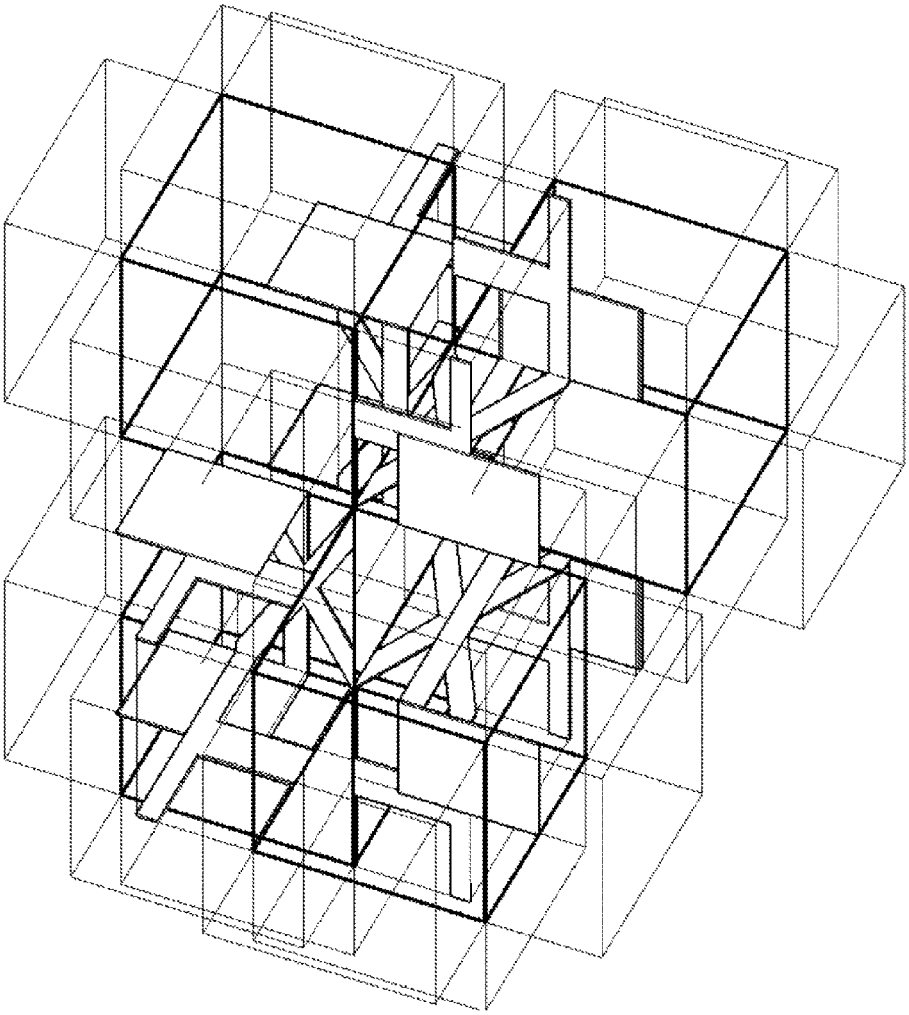
FIG. 24 depicts the protrusion sections of two construction components with two interlocking joints connected together in the process of coming into contact when interlocking components.
Figure 25:
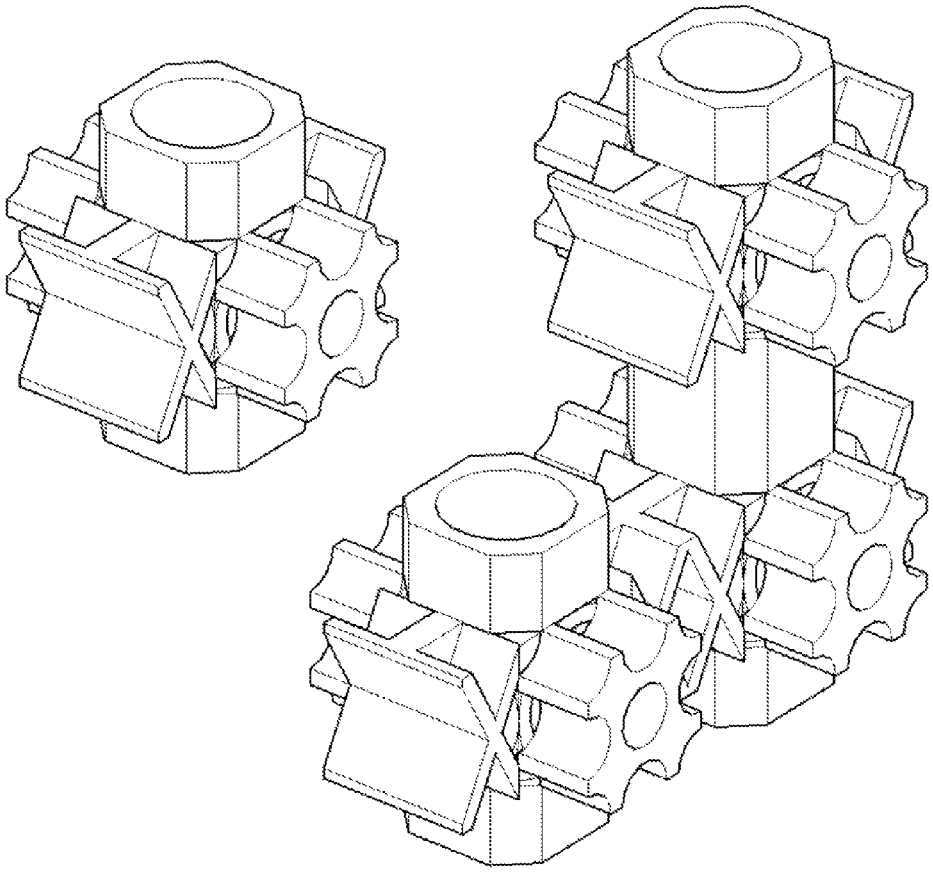
FIG. 25 shows two component constructions, one of which contains one interlocking joint, and the other containing three interlocking joints.

A connection between two construction components with two interlocking joints each is illustrated in FIGS. 21-24. FIGS. 22 and 24 show only protrusion sections of interlocking joints of construction components, which come into contact during connection and the resulting force of friction between thein keeps the components connected.

Figure 26:
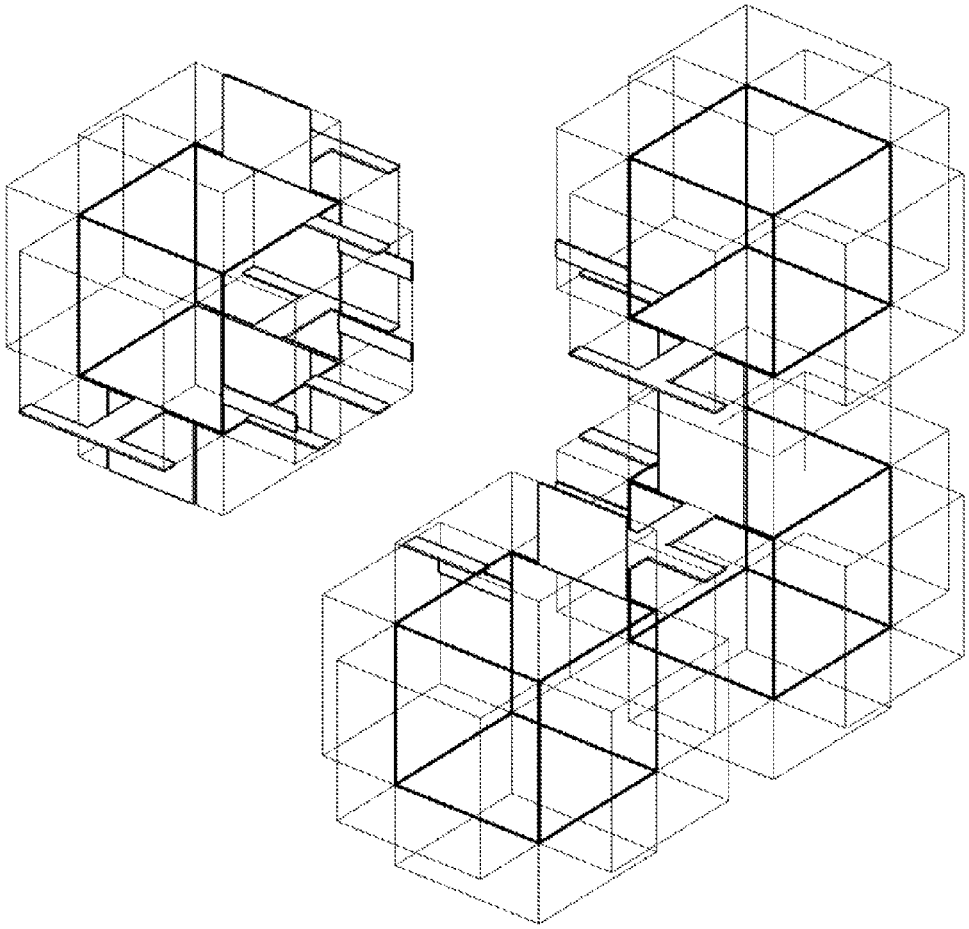
FIG. 26 shows the protrusion sections of two construction components as shown in FIG. 25 in the process of coming into contact when interlocking components.
Figure 27:
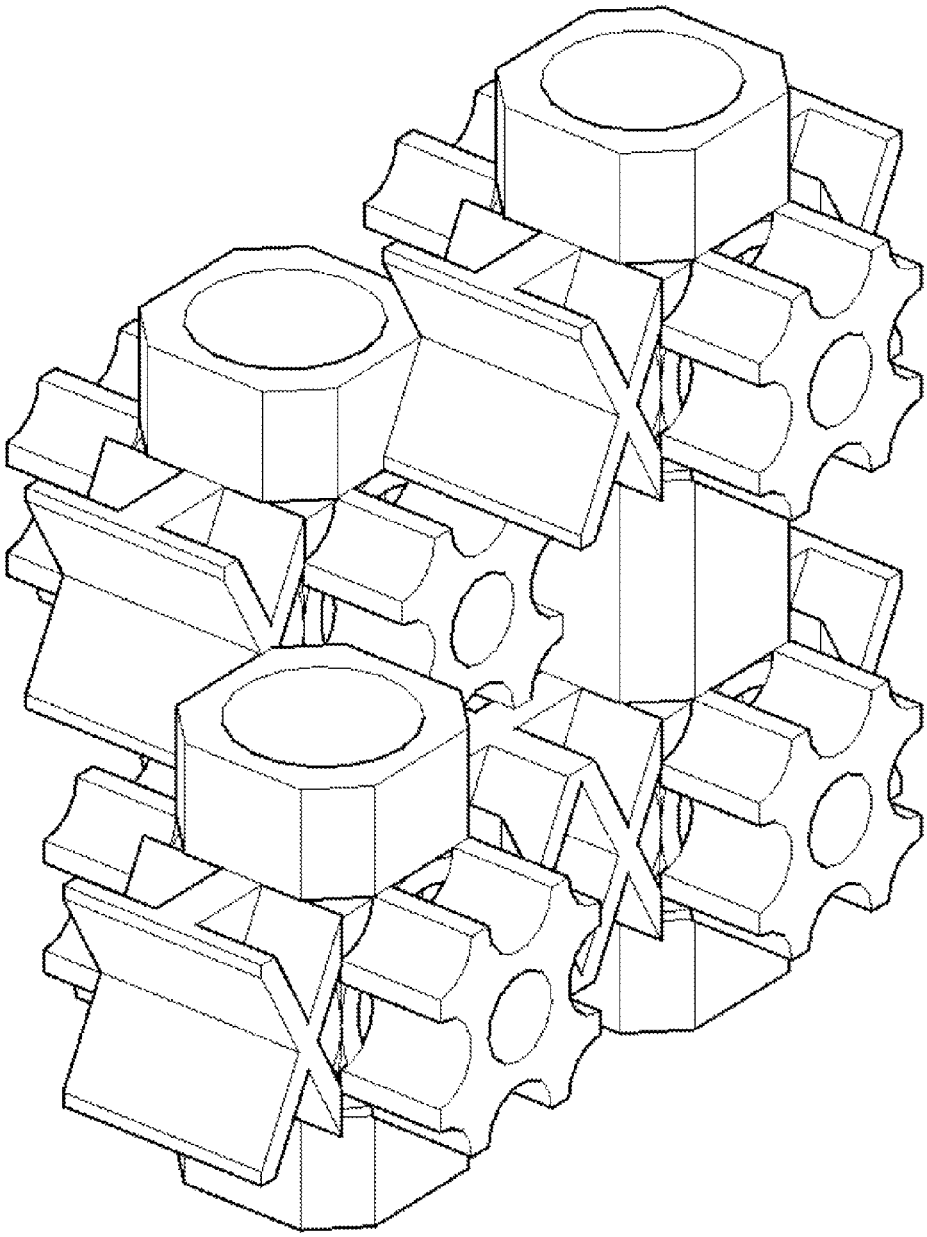
FIG. 27 shows two connected construction components where one has a single interlocking joint and the other one has three interlocking joints.
Figure 28:
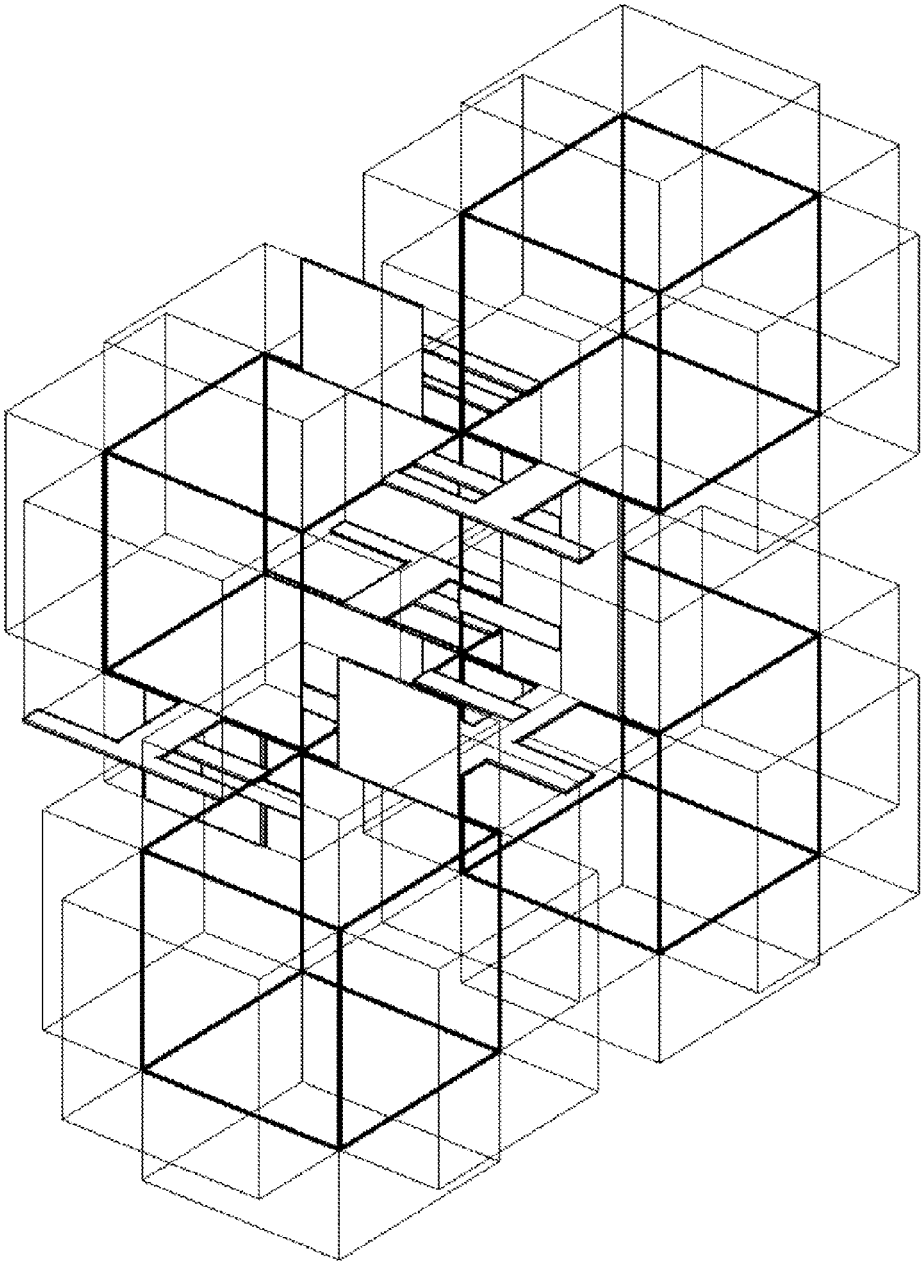
FIG. 28 depicts sections of two connected construction components shown in FIG. 27 coming into contact when interlocking components.

A connection between two construction components, where one has one interlocking joint and the other has three interlocking joints, is illustrated in FIGS. 25-28. The FIGS. 26 and 28 show only protrusions sections of interlocking joints of construction components, which come into contact during connection and the resulting force of friction between them keeps the components connected.

The invention claimed is:

1. A construction component comprising:

at least two interlocking joints, each of the interlocking joints being made in a form of a volumetric body with outer faces, at least some of which lie in planes that define a cube, said cube having cube edges with a length equal to a, where protrusions on at least one of said outer faces have a height that does not exceed a/2, the protrusions contain four protrusion sections, each arranged in the planes of the outer faces and adjacent to a surface having protrusions, where a distance between centers of neighboring cubes, defined by the outer faces, is equal to 2a and the protrusions are configured with a possibility of contact between protrusion sections of adjacent interlocking joints of neighboring construction components, wherein each outer face of the interlocking joint, lying on the plane of the outer face lies either in one of said planes of another interlocking joint or in one of said planes parallel to the plane of one of the cube faces of the cube of an adjacent interlocking joint; and said construction component is configured so that when it is interlocked with one or more adjacent construction components, at least one of said planes of the four protrusion sections, each arranged in the planes of the outer faces of the volumetric body, is in the same plane as at least one outer face of said one or more adjacent construction component.

2. A construction component comprising:

an interlocking joint in a form of a volumetric body with outer faces, at least some of which lie in planes that define a cube with a cube edge length equal to a, wherein protrusions are made on at least one of the above outer faces, and said protrusions have a height not exceeding a/2 and the protrusions contain four protrusion sections, each arranged on the planes of the outer faces adjacent to a face on the protrusions, and said construction component is configured so that when it is interlocked with one or more adjacent construction components, at least one of said planes of the four protrusion sections, each arranged in the planes of the outer faces of the volumetric body, is in the same plane as at least one outer face of said one or more adjacent construction component.

3. A construction kit comprising a plurality of construction components as defined in claim 1.

4. The construction kit of claim 3, further comprising at least one construction component as defined in claim 2.

* * * * *